United States Patent [19]

Morell et al.

[11] Patent Number: 4,715,542

[45] Date of Patent: Dec. 29, 1987

[54] FUEL INJECTION NOZZLE FOR INTERNAL COMBUSTION ENGINES

[75] Inventors: Josef Morell; Otto Freudenschuss; Harald Schmidt, all of Vienna, Austria

[73] Assignee: Steyr-Daimler-Puch AG, Vienna, Austria

[21] Appl. No.: 833,217

[22] Filed: Feb. 25, 1986

[30] Foreign Application Priority Data

Mar. 4, 1985 [AT] Austria ..... 628/85

[51] Int. Cl.[4] ..... F02M 61/20

[52] U.S. Cl. ..... 239/533.9

[58] Field of Search ..... 222/491, 494, 496, 497; 239/533.2, 533.3, 533.4, 533.5, 533.6, 533.7, 533.8, 533.9, 533.11, 533.13

[56] References Cited

U.S. PATENT DOCUMENTS

| | | | |
|---|---|---|---|
| 3,499,607 | 3/1970 | Thomson | 239/533.3 |
| 3,627,209 | 12/1971 | Scott | 239/533.9 X |
| 3,820,723 | 6/1974 | Shipinski | 239/533.9 |
| 4,168,804 | 9/1979 | Hofmann | 239/533.11 |
| 4,436,247 | 3/1984 | Akagi | 239/533.7 |
| 4,506,833 | 3/1985 | Yoneda et al. | 239/533.4 |
| 4,516,729 | 5/1985 | Fussner et al. | 239/533.9 X |

FOREIGN PATENT DOCUMENTS

| | | |
|---|---|---|
| 2711350 | 9/1978 | Fed. Rep. of Germany . |
| 3337891 | 4/1984 | Fed. Rep. of Germany . |
| 2093118 | 8/1982 | United Kingdom . |

*Primary Examiner*—Robert J. Spar
*Assistant Examiner*—Jay I. Alexander
*Attorney, Agent, or Firm*—Marmorek, Guttman & Rubenstein

[57] ABSTRACT

A fuel injection nozzle for internal combustion engines comprises a nozzle needle (2) guided in a nozzle body (1) and loaded by a helical pressure spring (4). The nozzle needle (2) moves under the pressure of the fuel out of its closure position onto a stop (6) which in turn is loaded by a further but stronger helical pressure spring (7) and limitedly displaceable against the force thereof. The stronger helical pressure spring (7) surrounds the weaker helical pressure spring (4) and the fuel flows through a bore (5) parallel to the spring axis. To achieve a reduction of the external diameter of the injection nozzle in the region of the two springs (4, 7) the latter arranged eccentrically rather than coaxially. Furthermore, between them a preferably likewise eccentric bush (8) is provided through which in the region of its greatest wall thickness the bore (5) for the inflowing fuel extends.

8 Claims, 2 Drawing Figures

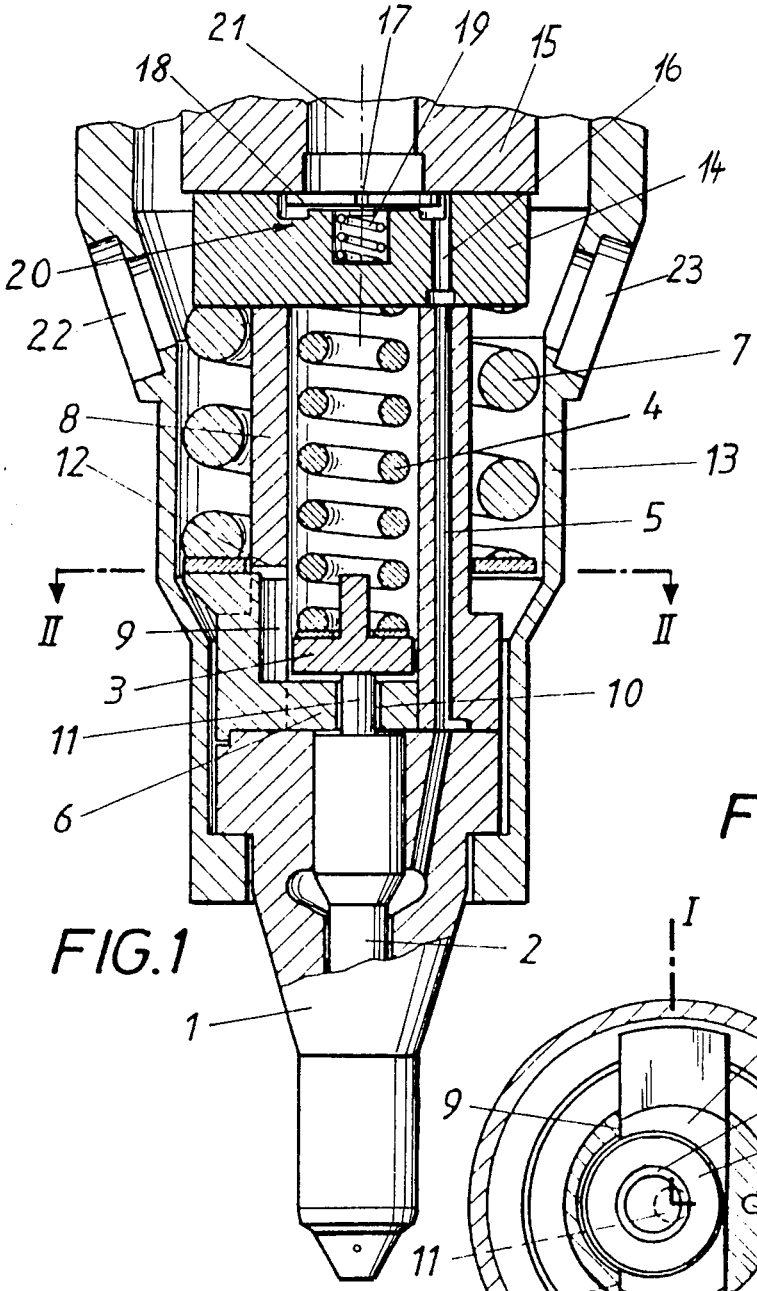
FIG. 1
FIG. 2
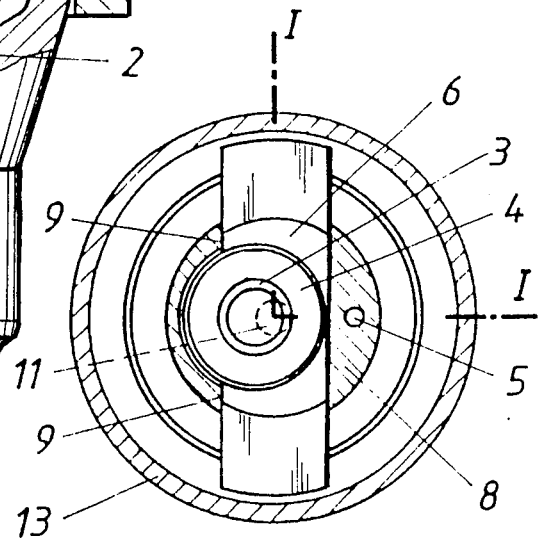

FUEL INJECTION NOZZLE FOR INTERNAL COMBUSTION ENGINES

The invention relates to a fuel injection nozzle for internal combustion engines comprising a nozzle needle which is guided in a nozzle body, loaded by a helical pressure spring and under the pressure of the fuel flowing in through a bore parallel to the spring axis which is moved out of its closure position onto a stop which in turn in limitedly displaceable against the force of a second stronger helical pressure spring which surrounds the first helical pressure spring.

In such fuel injection nozzles the nozzle needle is first lifted off its seat up to the stop and only on further pressure increase executes its complete lifting stroke, displacing the stop. There are thus two lifting phases. This has the advantage at low speeds and in the low part-load range of the internal combustion engine of delaying the full fuel delivery amount during the period of the ignition delay, a partial amount being ejected only after ignition has been completed or combustion has started. As a result the ignition noises are diminished and the hydrocarbon emissions reduced by a more favourable combustion course.

In a known fuel injection nozzle of this type (DE-OS No. 2,711,350) the two springs are arranged coaxially directly within each other and are surrounded by a hollow nozzle holder or the like on which the union nut clamping the nozzle body to the nozzle holder is screwed. The bore parallel to the spring axis for the inflowing fuel is provided in the nozzle holder which has over its entire periphery the same wall thickness corresponding to the bore diameter and the pressure forces in the bore. This arrangement resuls in the fuel injection nozzle having a comparatively large external diameter in the region of the union nut or the nozzle holder which presents difficulties in the fuel injection nozzle's installation. In particular, this arrangement excludes the desired installation of the injection nozzle at as acute an angle as possible to the cylinder axis of the internal combustion engine.

The invention is thus based on the problem of obviating this defect and further developing the fuel injection nozzle outlined at the beginning in such a manner that its external diameter in the region of the union nut or the like can be reduced to a minimum.

The invention solves the problem set in that the two helical pressure springs are arranged eccentrically to each other and between them a preferably likewise eccentric bush is provided through which in the region of its greatest wall thickness the bore for the inflowing fuel extends.

Due to the fact that the two helical pressure springs are no longer coaxial but are arranged eccentrically, between them a space is created for the eccentric bush which in the region between the greatest distance of the two springs can be given adequate wall thickness for accommodating the bore for the fuel and has adequate strength in the bore region, whereas on the diametrically opposite side it can be made very thin and take up there little space between the springs. Instead of an eccentric bush, however, a bush having substantially the same wall thickness could be provided which is then reinforced in the region of the maximum spacing for arranging the bore. Since the bush no longer surrounds the stronger helical pressure spring it is possible to provide this spring directly within the union nut or the like so that in the spring region altogether a substantial reduction of the external diameter of the fuel injection nozzle can be achieved.

A preferred embodiment of the stop consists of a star-shaped web, or a diametrical web which extends through the wall of the bush in longitudinal slots upon which the stronger outer helical pressure spring bears. The longitudinal slots have end faces which limit the movement of the web.

The stop also includes a center bore for the passage of a reduced-diameter nozzle needle extension. In a preferred embodient, the weaker first helical pressure spring acts upon this nozzle needle extension via a spring disc or washer. By this design, a simple construction is obtained, and the stronger second helical pressure spring is able to act on the stop for the nozzle needle which is in turn loaded by the weaker first helical pressure spring, in spite of the placement of the bush between the springs.

An example of embodiment of the subject of the invention is illustrated in the drawings, wherein:

FIG. 1 shows the parts essential to the invention of a fuel injection nozzle in vertical section along the line I—I of FIG. 2 and FIG. 2 is a cross-section along the line II—II of FIG. 1.

In the nozzle body 1 of a fuel injection nozzle intended for an internal combustion engine a nozzle needle 2 is guided which is loaded via a spring disc or washer 3 by a spring 4 and held in the closure position. For fuel supply from the pump a bore 5 parallel to the spring axis is provided. If the pressure of the fuel increases the nozzle needle 2 is lifted against the force of the spring 4 out of its closure position and comes to bear on a stop 6. The stop 6 is formed by a diametrical web on the end of which a second stronger pressure spring 7 bears, with its one end. With its other end the pressure spring squeezes against a cover 14 of a pump cylinder 15.

The two helical pressure springs 4, 7 are arranged eccentrically to each other and between them an eccentric bush 8 is provided through which in the region of its greatest wall thickness the bore 5 for the fuel supply extends. The web 6 traverses the bush 8 in longitudinal slots 9 and comprises a centre bore 10 for the passage of a reduced-diameter extension 11 of the nozzle needle 2. Adjacent to the bore 5 is provided a bore 16 connected with the pressure-chamber 21 of the pump-cylinder 15 via a valve consisting of a pressure plate 18 with a middle opening 17 and a spring 19.

If after the nozzle needle 2 comes to bear on the web or stop 6 the fuel pressure further increases the web or stop 6 moves against the force of the stronger outer spring 7, the end faces 12 of the longitudinal slots 9 limiting said thrust travel. The stronger outer spring 7 is surrounded directly by the union nut 13, having openings 22, 23 for the inlet and outlet respectively of the fuel.

We claim:

1. A fuel injection nozzle for internal combustion engines, comprising a body having an axis, a nozzle needle guided within said body along said axis, said nozzle needle being movable between an open and a closed position, a first helical pressure spring biasing said nozzle needle into its closed position, said first helical pressure spring being disposed along said axis, a second helical pressure spring disposed along said axis and surrounding said first helical pressure spring, said second helical pressure spring being stronger than said first helical pressure spring, said first and second helical pressure springs being arranged eccentrically relative to each other, a bush disposed eccentrically about said axis between said first and second helical pressure springs, said bush having a wall of non-uniform thickness and including a bore in the region of greatest thickness of the bush wall, said bore being parallel to said axis and delivering fuel under pressure to said nozzle needle to move said nozzle needle away from its closed position, and a movable stop associated with said nozzle needle for limiting movement of said nozzle needle, said second helical pressure spring acting to limit the movement of said stop.

2. A fuel injection nozzle in accordance with claim 1, wherein said stop comprises a star-shaped web.

3. A fuel injection nozzle in accordance with claim 1, wherein said stop is a web which extends diametrically through the bush.

4. A fuel injection nozzle in accordance with claim 3, wherein said web includes longitudinal slots extending through the wall of said bush, said second helical pressure spring bearing against said slots.

5. A fuel injection nozzle in accordance with claim 1, wherein said nozzle needle has an extension of reduced diameter, and said stop has a central bore for receiving said nozzle needle extension.

6. A fuel injection nozzle in accordance with claim 5, wherein said longitudinal slots have end faces which limit the movement of said stop.

7. A fuel injection nozzle in accordance with claim 1, wherein said first helical pressure spring acts on said nozzle needle via a spring disc.

8. A fuel injection nozzle in accordance with claim 1, wherein said first helical pressure spring acts on said nozzle needle via a washer.

* * * * *